US008011846B1

(12) United States Patent
Bates

(10) Patent No.: US 8,011,846 B1
(45) Date of Patent: Sep. 6, 2011

(54) PEN FLOWER

(76) Inventor: Marianne Bates, Bluffton, SC (US)

( * ) Notice: Subject to any disclaimer, the term of this patent is extended or adjusted under 35 U.S.C. 154(b) by 655 days.

(21) Appl. No.: 12/155,483

(22) Filed: Jun. 5, 2008

(51) Int. Cl.
*B43K 29/00* (2006.01)

(52) U.S. Cl. ..... 401/195

(58) Field of Classification Search ..... 401/52, 401/131, 195; 24/11 CT
See application file for complete search history.

(56) References Cited

U.S. PATENT DOCUMENTS

| | | | | | |
|---|---|---|---|---|---|
| D32,729 | S | | 5/1900 | Pinnell | |
| D74,519 | S | | 2/1928 | Power | |
| D147,885 | S | | 11/1947 | Blakeman | |
| D179,634 | S | * | 2/1957 | Gemora | D28/4 |
| 3,619,817 | A | * | 11/1971 | Rockwell | 2/250 |
| D257,156 | S | | 9/1980 | Pelletier | |
| D269,444 | S | | 6/1983 | Medebach | |
| 4,678,206 | A | * | 7/1987 | Leahan | 281/44 |
| D337,611 | S | | 7/1993 | Peersmann | |
| 5,308,179 | A | | 5/1994 | Whitright | |
| D349,726 | S | | 8/1994 | Radmilovic et al. | |
| 5,547,721 | A | * | 8/1996 | Kuo | 428/34.1 |
| D376,619 | S | | 12/1996 | Chang | |
| D391,291 | S | | 2/1998 | Chang | |
| 6,045,281 | A | | 4/2000 | Bunn et al. | |
| 6,234,699 | B1 | * | 5/2001 | Brode | 401/195 |
| D446,811 | S | | 8/2001 | Beard | |
| 6,773,188 | B1 | | 8/2004 | Tamaye | |
| D504,915 | S | | 5/2005 | Ng | |
| 7,059,797 | B2 | | 6/2006 | Sellars | |

* cited by examiner

*Primary Examiner* — David Walczak
(74) *Attorney, Agent, or Firm* — Paul R. Martin

(57) ABSTRACT

A pen flower comprises an artificial flower head attached to the cap end of a writing instrument and flower stem-like appearing material, such as floral wrap, wrapped around the writing instrument to re-design a writing instrument, such as a standard ball point pen, into the appearance of a flower. The pen flower further comprises a flower pot containing smooth spherical elements such as marbles or beads. A plurality of flower pens are placed in the spherical elements in the flower pot with the flowers on at least some of the instruments being located outside the pot whereby the writing instruments are held in the flower pot in a manner which produces an appearance of a potted flower while also allowing each writing instrument to be easily removed from the pot for use and replaced into the pot to re-establish the potted flower effect.

4 Claims, 4 Drawing Sheets

PEN FLOWER

TECHNICAL FIELD OF THE INVENTION

The present invention relates to the general art of writing instruments, and to the particular field of decorative writing instruments.

BACKGROUND OF THE INVENTION

The pen and pencil have been in use by humankind for many hundreds of years. While the origin and design of these simple writing tools is uncertain, it is certainly true that over the years pens and pencils have been seen in a marvelous variety of configurations. One of the most fanciful of these types of instruments is the colonial age quill pen. More modern designs include the popular number 2 size pencil manufactured by the Dixon Ticonderoga company, the Bic Company's disposable ballpoint pen, and the classic fountain pens manufactured by the Mont Blanc company.

However despite the wide array of writing instruments to choose from, the overall designs of these instruments are uninspired. This lack of design creativity has resulted in a significant secondary market of decorative erasers, pen lights, and other novelty type devices for persons interested in making a statement beyond those on paper. Therefore, there is a continuing need for attractive writing instruments.

In many situations, it is desirable to provide customers with writing instruments such as to facilitate the customers' ability to complete forms such as signing credit card receipts, personal checks or the like. Accordingly, writing implements, such as pens and pencils, are routinely placed in public areas for repeat use by persons patronizing that area. Examples of places where this occur are retail establishments, banks, schools, service stations, restaurants, public offices, and the like. As the majority of consumers do not carry a writing instrument on their person, it is standard retail procedure to provide a writing instrument, usually a ballpoint pen, at the point of sale, for example on the sales counter. As fewer and fewer customers complete their transactions with cash payments, more and more customers use and are exposed to these retailer supplied writing instruments. A common problem occurs when patrons or visitors to these places remove the writing implement either on purpose or by accident. This occurs on a regular and repetitive basis because most writing implements are compact and easily fit into a pocket or purse. In addition, many persons as a matter of subconscious habit, replace writing implements into their clothing or carrying cases without thinking whether that implement is their property or not since most of these implements look and feel alike. As a result, before the available supply of writing medium (e.g., ink, pencil lead, etc.) is actually depleted, the average writing implement must be replaced. In such a case, excessive expense and time are expended while the writing implements are replaced by the institution that had made the implement available in the first place.

Even though the writing instruments can be replaced fairly inexpensive, the costs associated with continually replacing the writing instruments has encouraged businesses to take steps to reduce the likelihood that the writing instruments will be taken. Some business owners have resorted to tethering their pens to a stationary object, such as a desk or a sales table. Pens found in banks are examples of this process. A downfall of this technique is that the string or chain often impairs the ability of customers to use the writing instruments. Another way businesses have sought to discourage customers from taking writing instruments has been to increase their dimensions. One common way to discourage theft is by simply taping a plastic spoon to the writing instrument. Some businesses simply "go with the flow" and place advertisements on their pens and allow customers to walk off with the pens. Another method used to thwart the loss of pens is to make the pens so unattractive that nobody wants to take them.

While somewhat successful, all of these methods have drawbacks. Therefore, there is a need for a means for making a pen attractive, yet which will discourage a person from taking a pen with them.

SUMMARY OF THE INVENTION

The above-discussed disadvantages of the prior art are overcome by a pen flower that comprises an artificial flower head attached to the cap end of a writing instrument and flower stem-like appearing material, such as floral wrap, wrapped around the writing instrument to re-design a writing instrument, such as a standard ball point pen, into the appearance of a flower. The pen flower further comprises a flower pot containing smooth spherical elements such as marbles or beads. A plurality of flower pens are placed in the spherical elements in the flower pot with the flowers on at least some of the instruments being located outside the pot whereby the writing instruments are held in the flower pot in a manner which produces an appearance of a potted flower while also allowing each writing instrument to be easily removed from the pot for use and replaced into the pot to re-establish the potted flower effect. Roses, carnations, mums, etc. will fit into this design scheme. An assortment of colors can also be incorporated into the design. Standard floral tape or standard floral wire can be used to attach the artificial flower head to the writing instrument. The flower head can be formed of plastic, Styrofoam, or any other suitable material.

The present invention can be easily attached to virtually any writing implement. It effectively prohibits inadvertent removal of such implement. As to persons who are inclined to appropriate the writing implement on purpose, the present invention makes this a less attractive opportunity because the enhanced size and shape make the implement and apparatus difficult to conceal in pocket or purse and less advantageous to discretely use in the future.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 3:
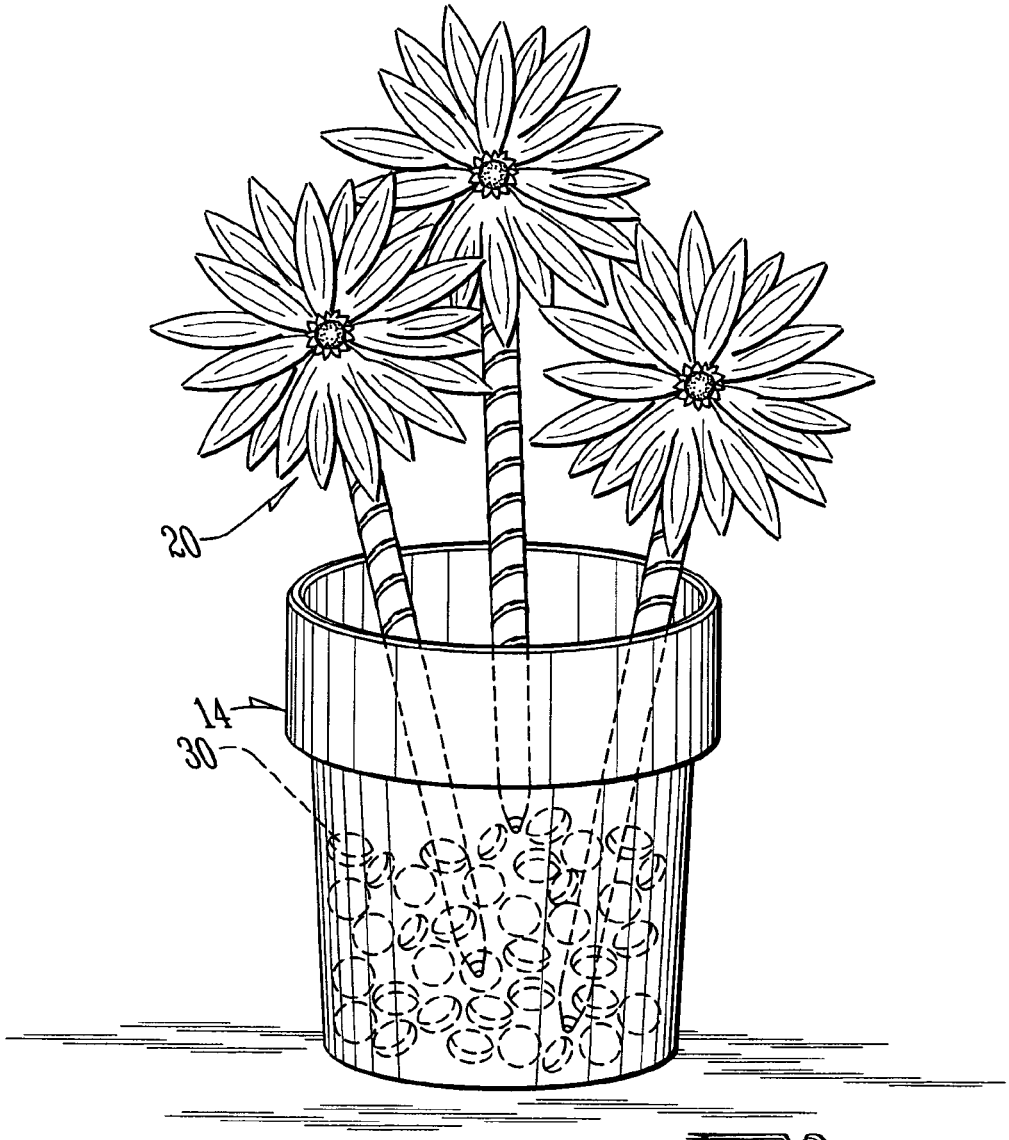
FIG. 3 is a pen flower embodying the principles of the present invention.
Figure 4:
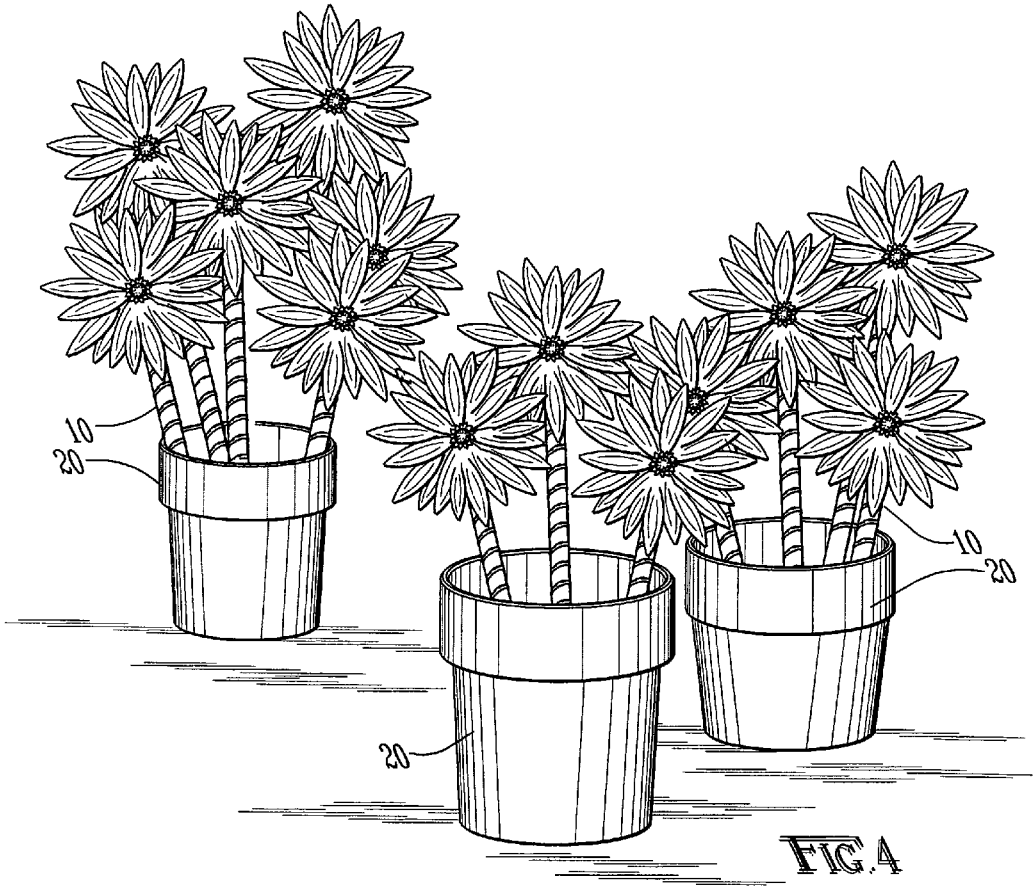
FIG. 4 shows a stand of pen flowers embodying the principles of the present invention.

Referring to the figures, it can be understood that the present invention is embodied in a writing instrument 10 that has a pen 12, such as a standard ball point pen or the like, modified to have an appearance of a flower. As can be understood from the figures and from the teaching of this disclosure, a plurality of such flower pens are combined into a common flower pot 14 to have the appearance of a potted plant 20. As indicated in FIG. 4, a plurality of pots can be combined to form a stand of such potted plants. As will be discussed herein, each pot contains a multiplicity of smooth spherical elements, such as marbles 30 or beads, whereby the flower pens are easily inserted for storage and removed for use, while still retaining the appearance of a potted plant. The marbles are indicated in FIG. 3 as they are preferably located near the bottom of the pot. The marbles are inexpensive, easy to control and securely support each pen while still permitting the writing instruments to be easily inserted into and withdrawn from the pot.

Figure 1:
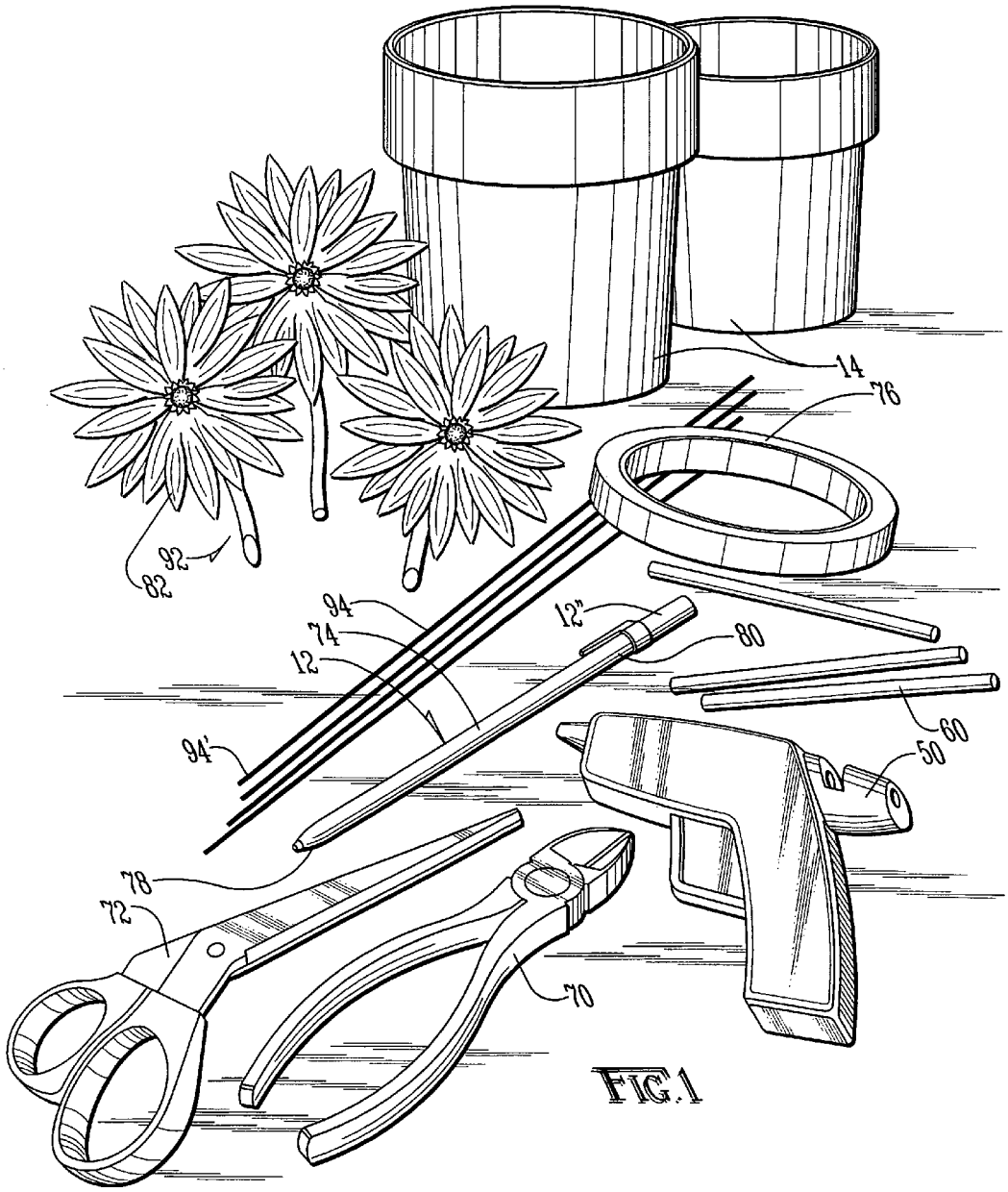
FIG. 1 is a perspective view of the implements and accessories used to form a flower pen and pen flower embodying the principles of the present invention.
Figure 2:
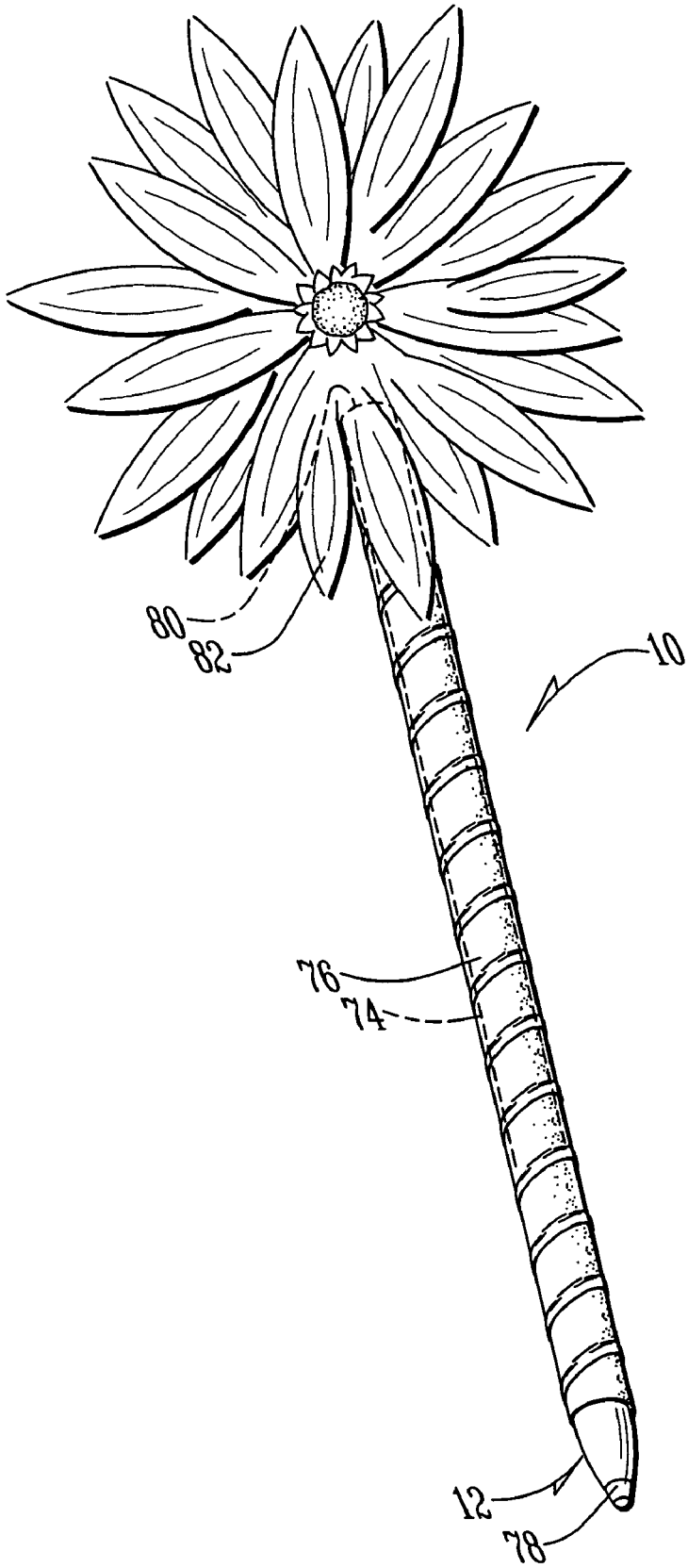
FIG. 2 is a perspective view of a pen flower formed according to the teaching of this invention.

As can be understood from FIG. 1, in addition to a writing instrument 10, the only tools required to effect the transformation of a standard writing instrument into the pen flower of the present invention include: a glue gun 50, glue 60, wire cutters 70 and scissors 72.

Each writing instrument includes the standard instrument, such as a ball point pen, having the shaft 74 thereof wrapped with floral tape 76 in a helical pattern between writing tip 78 and cap end 80 and which has a flower 82 attached to cap end 80 thereof. The helical pattern of the floral wrap provides an appearance of a flower stem. As can be understood from FIG. 3, the writing instruments are sized so that at least some, if not all, the flowers are located outside the pot when the instruments are supported therein by the spherical elements, thus contributing to the overall flower pot appearance. As indicated in FIG. 4, the pots can have different sizes and the flowers in each pot and in the various pots can be varied to provide various aesthetic effects.

The process embodying the present invention comprises the following steps: STEP ONE: remove flowers 82 from each flower of a bouquet 92; STEP TWO: organize and cut floral wire 94 into strips, each of which is approximately 2¼-2½ inches in length using wire cutters 70; STEP THREE: cut a writing instrument adjacent to the cap end 80 thereof so wire can be threaded into the instrument and remove cap 12"; STEP FOUR: heat glue gun 50; STEP FIVE: place hot glue on end tip 94' of a strip of floral wire 94 and insert the glue-holding tip into a bottom of a flower, then immediately insert the flower-attached wire into the writing instrument while making sure the glue also adheres to the writing instrument itself, press firmly so the flower and wire are intact and the flower is unable to come off the instrument; STEP SIX: once glue dries, wrap the writing instrument with floral tape 76 along the length of the shaft, the shaft should be wrapped at least two times; STEP SEVEN: place smooth spherical elements, such as marbles or beads, into a pot and place the finished writing instrument into the pot 14 to be held by the spherical elements.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A pen flower comprising:

A) a flower pot;

B) a multiplicity of smooth spherical elements contained in the flower pot; and

C) a plurality of flower pens, with each pen being inserted into the spherical elements to be held in the flower pot by the elements in the manner of a flower, each flower pen including (1) a writing pen having a writing tip on a first end and a second end and a shaft extending between the first and second ends of the pen, (2) floral wire adhesively attached to the inside of the pen adjacent to the second end of the pen, (3) an artificial flower adhesively attached to the floral wire whereby the artificial flower is attached to the pen; and (4) floral wrap wrapped around the shaft of the writing pen from the first end to the second end of the pen.

2. The pen flower defined in claim 1 wherein the floral wrap is wrapped around the shaft of the pen in a helical pattern.

3. The pen flower defined in claim 1 wherein the flower on a pen is located outside the flower pot when the pen associated therewith is supported by the spherical elements in the flower pot.

4. The pen flower defined in claim 1 wherein the spherical elements are marbles.

* * * * *